US005893486A

United States Patent [19]

Wasmire

[11] Patent Number: 5,893,486

[45] Date of Patent: Apr. 13, 1999

[54] FOAM DISPENSING DEVICE

[75] Inventor: Frederick D. Wasmire, Alliance, Ohio

[73] Assignee: Liquid Control Corporation, North Canton, Ohio

[21] Appl. No.: 08/864,027

[22] Filed: May 27, 1997

[51] Int. Cl.[6] ..... B67D 5/58

[52] U.S. Cl. ..... 222/190; 222/195; 366/101

[58] Field of Search ..... 222/145.6, 195, 222/190, 136, 389; 366/101, 339; 239/427.5

[56] References Cited

U.S. PATENT DOCUMENTS

| | | | |
|---|---|---|---|
| 3,093,311 | 6/1963 | Morris et al. | 366/101 |
| 4,046,358 | 9/1977 | Grimes | 366/101 |
| 4,366,919 | 1/1983 | Anderson | 222/137 |
| 4,643,336 | 2/1987 | Mandeville et al. | 222/145.6 |
| 4,674,888 | 6/1987 | Carlson | 366/101 |
| 4,801,008 | 1/1989 | Rich | 206/219 |
| 5,033,650 | 7/1991 | Colin et al. | 222/137 |
| 5,163,584 | 11/1992 | Huber et al. | 222/195 |
| 5,184,757 | 2/1993 | Giannuzzi | 222/82 |
| 5,397,180 | 3/1995 | Miller | 366/338 |
| 5,443,183 | 8/1995 | Jacobson et al. | 222/145.6 |
| 5,566,860 | 10/1996 | Schiltz | 222/94 |

*Primary Examiner*—Philippe Derakshani
*Attorney, Agent, or Firm*—Sand & Sebolt

[57] ABSTRACT

A foam-dispensing device includes a main tubular housing which houses a material cartridge. Several chambers are formed within the material cartridge with each chamber containing a separate material. A motionless mixer is attached to the dispensing end of the cartridge. The motionless mixer includes a tapered rear end into which the materials flow exposing the materials to one another, and a front end containing a helical mixing element. A hole is formed transversely in the motionless mixer between the rear end of the mixer and the helical mixing element for receiving a supply of pressurized gas therethrough. The materials flow out of the cartridge and into the rear end of the motionless mixer. After the materials have been exposed to one another, the materials pass by the hole and are injected with the supply of pressurized gas. The pressurized gas is injected into all of the materials after the materials have contacted one another but before the materials are mixed together by the helical mixing element. The aerated materials flow through the helical mixing element and are mixed into a foam compound before being dispensed from the foam-dispensing device.

12 Claims, 1 Drawing Sheet

FOAM DISPENSING DEVICE

BACKGROUND OF THE INVENTION

Technical Field

The invention relates to a dispensing device and more particularly to a foam dispensing device having a motionless mixer tube for mounting on the end of the dispensing device which mixes pressurized air with at least two materials creating an aerated foam compound. More particularly, the invention relates to such a foam dispensing device whereby the pressurized air is injected into the motionless mixer tube for aerating both of the materials after the materials have been exposed to one another but before the materials are thoroughly mixed together by the motionless mixer tube.

Background Information

Various types of dispensers have been developed for dispensing a volume of fluid materials, such as chemically reactive resins, or resins and a hardener, which materials must be maintained out of contact with each other within the dispenser. When the materials are mixed, they chemically react to form a final product. Some of these resins require that they be dispensed as a foam compound requiring a supply of pressurized air to be injected and mixed with the materials prior to the resin being applied to a desired surface. One example of such a resin is sold under the trademark ISOFOAM which is manufactured by Witco Chemical Corporation of New York, N.Y.

Several types of prior art dispensing devices are currently used to mix the separate materials with a supply of pressurized air to produce a foam resin or compound. One of these devices uses a dynamic blade mixer having moving mixing blades which mix the materials together and inject the mixed compound with pressurized air. These types of dynamic mixers are often large and relatively expensive. A motor of some type must be used to turn the blades and mix the materials and air. After the resin has been dispensed from these mixers, the mixers must be cleaned to prevent any excess resin from hardening on the blades or within the dispensing opening.

Another type of prior art mixer used to mix materials and pressurized air injected the pressurized air into one of the separate materials prior to the one material being mixed with other materials. The material into which the air is injected is mixed with the other materials using a motionless or static mixer and then dispensed through a dispensing tube. The motionless mixer includes a disposable plastic tube containing a helical mixing element therein and is removably attached to the end of a dispensing gun. The materials enter the mixing tube from separate material cartridges and are mixed as they flow through the tube. The pressurized air is input into only one of the cartridges and thus only one of the materials has foam properties prior to the materials being exposed to one another.

The problem with these types of dispensing devices is that the pressurized air is injected into only one of the separate materials and must then be mixed with the other material by the motionless helical mixer. Often, the materials are not thoroughly mixed to create a foam resin having a uniformly aerated consistency. The resulting foam resin cannot be properly applied, will not harden properly and thus will not be as effective in the use for which it was intended.

Therefore, the need exists for an improved dual component foam dispensing device in which a supply of pressurized air is injected into all of the separate materials being mixed by the dispensing device, and in which the air is injected into the materials after the materials have been exposed to one another yet prior to the materials being mixed by a helical mixing element of a motionless mixer.

SUMMARY OF THE INVENTION

Objectives of the invention include providing an improved dual component foam dispensing device having a motionless mixer mounted on the discharge end thereof which enables a supply of pressurized air to be injected into all of the materials being mixed and dispensed by the dispensing device.

Another objective of the invention is to provide such a dispensing device which injects the pressurized air into the materials after the materials have been exposed to one another thereby aerating each of the separate materials.

A further objective is to provide such a dispensing device in which the pressurized air is injected into the materials prior to the materials being mixed together by the helical mixing element of the motionless mixer.

A still further objective of the invention is to provide such a dispensing device in which the motionless mixer is disposable and is removably attached to the discharge end of the dispensing device.

A further objective of the invention is to provide such a dispensing device which dispenses a foam compound having a uniformly aerated consistency.

Another objective of the invention is to provide such a dispensing device which may use coaxial material cartridges as well as side-by-side material cartridges.

Another objective of the invention is to provide such a dispensing device which is of a simple construction, which achieves the stated objectives in a simple, effective and inexpensive manner, which solves problems and satisfies needs existing in the art.

These objectives and advantages are obtained by the improved foam dispensing device of the present invention, the general nature of which may be stated as including a housing; a cartridge stored in the housing and adapted to contain at least one material, said cartridge having a dispensing end; a pressure mechanism for forcing the material out the dispensing end of the cartridge; a dispensing tube mounted to the dispensing end of the cartridge, said dispensing tube having a wall formed with a passageway; a static mixing element positioned within the passageway of the dispensing tube; and means communicating with the dispensing tube for supplying a pressurized gas into the passageway for mixing with the material for forming the foam material.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF PREFERRED EMBODIMENT

Figure 1:
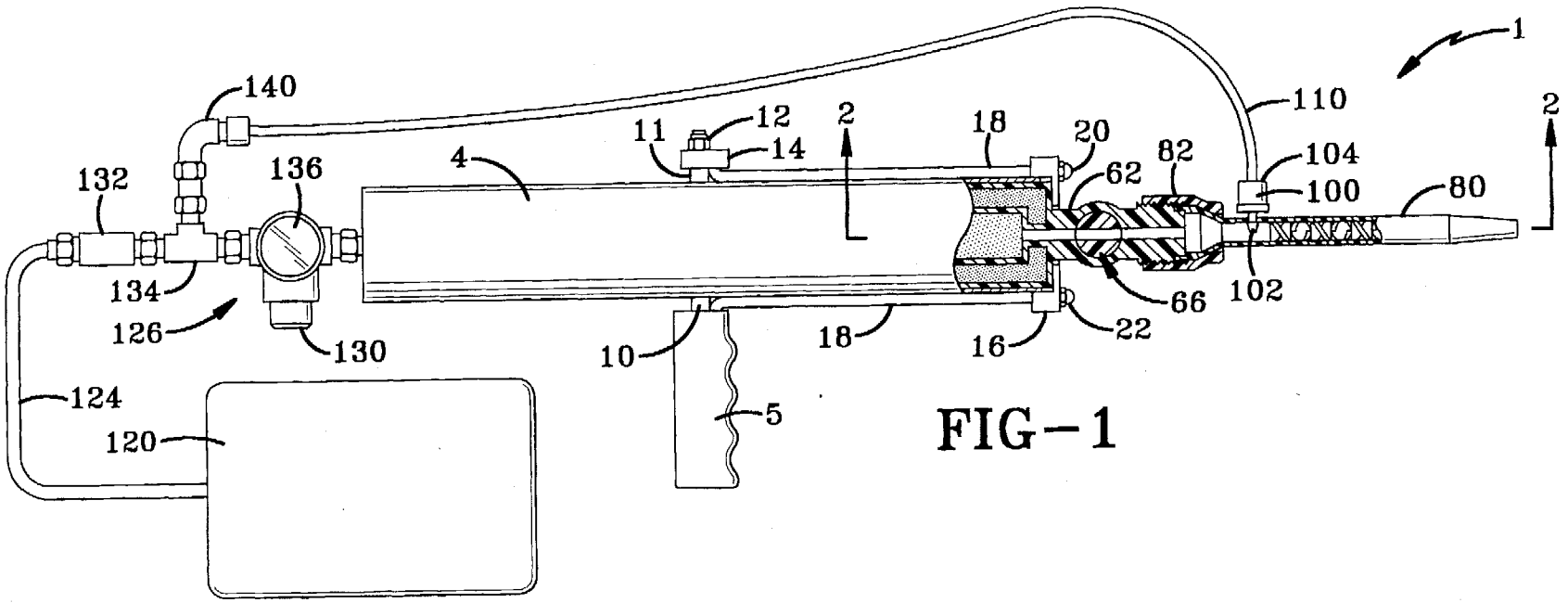
FIG. 1 is a side elevational view of the foam dispensing gun of the present invention with a portion in section showing the pressurized air inlet of the motionless mixer tube.

The foam dispensing device of the present invention is indicated generally at 1 in FIG. 1 and is shown in a dispensing gun configuration. Dispensing device 1 consists of a main cylindrical tubular housing 4 (FIG. 2) and has a handle 5 secured thereto and extending generally transversely from tube 4 for manually gripping by an operator of gun 1. A handle rod 10 is mounted on tube 4 for supporting handle 5. A post 11 diametrically opposes handle rod 10 and is secured to tube 4 by a nut 12 and a washer plate 14. A cartridge retainer 16 is movably mounted on housing 4 by a pair of cartridge rods 18 which are pivotally mounted to housing 4. Top cartridge rod 18 is secured to retainer 16 at a first end by a nut 20 and includes a L-shaped second end which engages a hole formed in washer plate 14. Bottom cartridge rod 18 is secured to retainer 16 at a first end by a nut 22 in a manner similar to that of the top cartridge rod and includes a L-shaped second end which extends into and engages handle 5.

Figure 2:
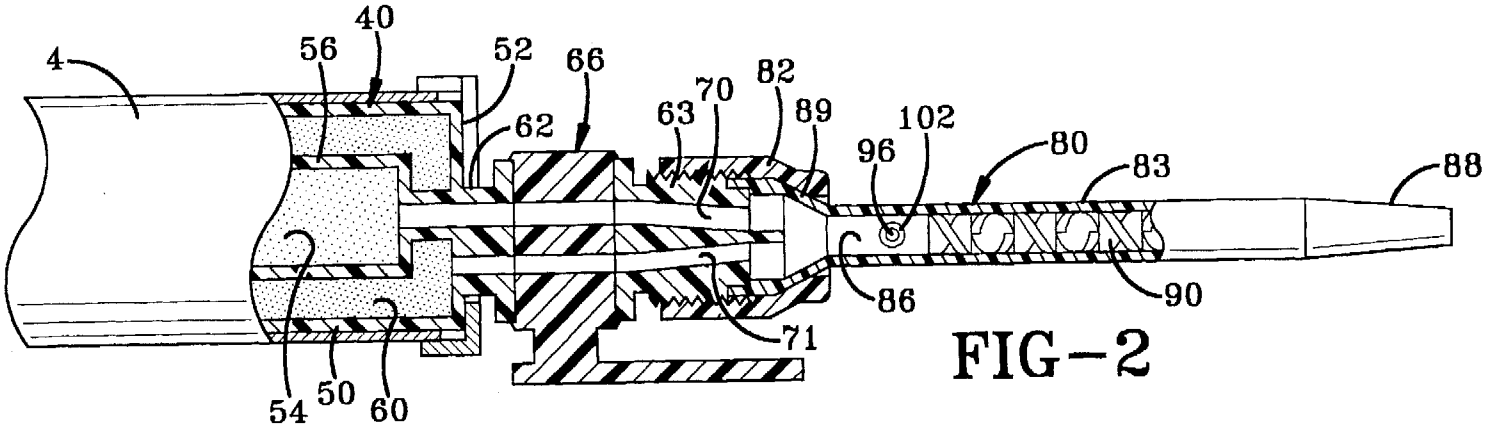
FIG. 2 is an enlarged top plan view with a portion in section showing the motionless mixer tube, control valve and a portion of the dual component of FIG. 1.

A material cartridge 40 is removably mounted within the forward or front end of housing 4 by retainer 16 and is acted upon by a pair of pistons (not shown) for simultaneously dispensing a pair of material components stored within cartridge 40. The materials stored in cartridge 40 may be a liquid, paste, slurry or any type of material which is movable and flowable under pressure and will be hereinafter referred to as a liquid. Cartridge 40 includes a tubular cylindrical body 50 formed with a front closure wall 52. A first or inner chamber 54 is formed within cylindrical body 50 by a cylindrical wall 56 which is connected to and extends from front wall 52 to the open end coaxially within cylindrical body 50 which, in turn, forms a second or outer annular chamber 60, which surround inner chamber 54. Chambers 54 and 60 are shown in FIGS. 1 and 2 in a coaxial configuration but may be positioned side-by-side as shown in U.S. Pat. No. 5,566,860 which is incorporated herein by reference.

A neck portion 62 is formed integrally with end wall 52 and extends forwardly therefrom and terminates in a discharge nozzle 63. Neck 62 may include a valve member, indicated generally at 66, which is rotatably mounted within the neck for controlling the flow of the two material components therethrough. Valve member 66 may be of the type shown in U.S. Pat. No. 4,846,373, the contents of which are incorporated herein by reference. Neck portion 62 is formed with a pair of material passageways 70 and 71, which communicate with inner and outer chambers 54 and 60, respectively, for permitting the flow of the materials from the chambers through neck portion 62 and out of nozzle 63.

A motionless mixer tube 80, such as that shown in U.S. Pat. No. 4,014,463, is threadably removably mounted on cartridge 40 by a coupler 82. Mixer 80 is generally cylindrical shaped and has a cylindrical wall 83 which forms a central passageway 86. Central passageway 86 communicates with both of material passageways 70 and 71. Wall 83 is formed with a front tapered open end 88 through which the materials are dispensed. Mixer 80 includes a rear outwardly tapered or funnel-shaped end section 89 which abuts and engages the front end of nozzle 63. Mixer 80 includes an internal helical mixer 90 positioned within passageway 86 which mixes the two material components as the materials are dispensed through mixer 80.

In accordance with the invention, a circular air pressure inlet hole 96 is formed transversely in wall 83 of mixer 80 adjacent rear tapered section 89. Hole 96 is formed between rear tapered section 89 and helical mixer 90 and receives an air hose fitting 100. Fitting 100 has a barbed first end 102 which extends through hole 96 and engages the inner surface of wall 83 of mixer 80 to retain fitting 100 in place. Fitting 100 has a second end 104 which receives the end of an air hose 110. Air hose 110 supplies a quantity of pressurized air or gas from an air compressor 120 through fitting 100 and hole 96 and into passageway 86 of mixer 80.

Air compressor 120 generates a supply of pressurized air which is output through an air hose 124 to a pressure regulator assembly 126. Pressure regulator assembly 126 includes a usual pressure regulator 130 which is connected to and regulates the amount of pressure supplied to housing 4, a straight coupling 132 which is connected to air hose 124, and a T-coupling 134 connected between straight coupling 132 and pressure regulator 130. Pressure regulator 130 includes a meter or gauge 136 which displays the amount of pressurized air input into housing 4 for slidably moving the piston rods and pistons contained therein. T-shaped coupling 134 diverts a portion of the pressurized air supplied by air compressor 120 through an elbow coupling 140. Elbow coupling 140 is connected to the other end of air hose 110 for supplying the diverted pressurized air into mixer 80.

In operation, dispensing gun 1 is used to dispense foam compounds, such as expansible or flexible resins, involving polyisocyanates, polyurethanes and similar polymers as chemicals and chemical compositions, which polymers may be derived from polyesters or polyethers and polyisocyanates, or equivalents thereof. One example of such a foam compound is sold under the trademark ISO-FOAM and is manufactured by Witco Chemical Corporation of New York, N.Y. The materials used to create these foams are stored in chambers 54 and 60 of cartridge 40 and are dispensed through mixer 80. Because of the limited amount of space within cartridge 40, the materials contained within chambers 54 and 60 are stored as liquids and must be aerated to produce the desired foam properties before being dispensed through end 88 of mixer 80. By storing the materials as a liquid rather than as a foam, a greater amount of each material may be stored in each of chambers 54 and 60.

As air compressor 120 supplies pressurized air through air hose 124 and air pressure regulator assembly 126, a pair of piston rods and pistons slide within housing 4 towards the front thereof and force the materials contained within chambers 54 and 60 through passageways 70 and 71, respectively. Valve 66 is rotated to the open position shown in FIG. 2 whereby the passageways of neck 62 communicate with the passageways of nozzle 63 allowing the materials to flow therethrough. The materials are first exposed to and come into contact with one another when the materials exit passageways 70 and 71 and enter tapered rear end 89 of mixer 80. When the materials are first exposed to one another within rear end 89 of mixer 80 they are still in their liquid form.

As the liquids are pushed through passageway 86 of mixer 80, the combined materials pass by air pressure inlet hole 96. As the pressurized air from air compressor 120 flows through pressure regulator assembly 126 to dispense the materials of cartridge 40, a small amount of air is diverted through T-coupling 134 and elbow coupling 140 and is supplied through air hose 110 and fitting 100 into passageway 86 of mixer 80. As the materials pass by hole 96, the pressurized air is injected into both of the materials simultaneously. As shown in FIG. 2, passageways 70 and 71 are formed side by side with each material flowing within one side of passageway 86. Hole 96 is formed centrally between the right and left sides of mixer 80 causing at least a portion of each material to pass by hole 96 thus assuring that each material is injected with at least some portion of the pressurized air.

After the pressurized air has been injected into mixer 80 to aerate each of the materials, the materials are further pushed through helical mixing element 90 to be thoroughly mixed with one another before being dispensed through end 88. By injecting the pressurized air into both of the materials, the materials can be better mixed by helical mixing element 90 than if only one of the materials was aerated into a foam while the other remained in its liquid state. With hole 96 formed centrally between the right and left sides of mixer 80 both materials will be injected with at least some portion of the pressurized air.

As the pressurized air is injected through air hose 110 and fitting 100, the aerated materials will expand within passageway 86. Helical mixing element 90 slightly impedes the flow of the materials through mixer 80 creating a back pressure within passageway 86. The pressure of the diverted air applied through air hose 110 and fitting 100 must be great enough to resist this back pressure and prevent the foam from expanding back up through fitting 100. Also, the pressure applied to the piston rods and pistons within housing 4 must be great enough to prevent the foam from expanding back through passageways 70 and 71. If the pressures applied through passageways 70 and 71 and hole 96 is great enough, the foam will naturally flow through helical mixing element 90 and out end 88 of mixer 80.

The amount of pressure which is applied through pressure regulator 130 and to the pistons and piston rods will depend on the type of materials being dispensed by device 1. For a typical application this pressure will be approximately 40 psi. Further, if a high pressure is applied through regulator 130 to the pistons, the materials and resulting foam will travel through passageways 70, 71 and 86 at a higher flow rate. When the foam exits helical mixing element 90 and is exposed to the low-pressure atmosphere outside of mixer 80 the foam will expand considerably allowing the foam to be sprayed onto an application surface.

Although in the preferred embodiment main tube 4 is shown using pressurized air to dispense the materials from their cartridges, the pistons and piston rods thereof may be electrically, hydraulically or even manually operated, provided that a supply of pressurized air is injected into hole 96 and provided that enough pressure is applied through hole 96 and passageways 70 and 71 to prevent backflow of the foam. The pressurized air which aerates the materials could be supplied by an air tank containing a gas such as nitrogen, as well as from air compressor 120. Certain resins or compounds may require a certain type of gas which assists the chemical reaction of the materials. By supplying the pressurized gas through hole 96 from a tank, these certain types of gases can be injected into the materials.

As previously discussed, mixer 80 can be used on a foam dispensing gun having coaxial cartridges, as shown in FIGS. 1 and 2, as well as dispensing guns having side-by-side cartridges. Furthermore, cartridge 40 may contain any number of chambers filled with separate materials which are to be mixed by helical mixer 90. After the materials are exposed to one another within rear end 89 of mixer 80, all of the materials will be aerated by the pressurized air flowing through hole 96. Once the separate materials have been exposed to one another and injected with the pressurized air, the materials will flow through and be thoroughly mixed by helical mixer 90. Additionally, mixer 80 may be used to aerate a single material stored as a liquid in a cartridge having a single chamber but which requires, a supply of pressurized air to convert the liquid into a foam. Helical mixer 90 would merely further mix the pressurized air with the material to create a foam of a uniform consistency.

Accordingly, mixer 80 may be used with various types of foam-dispensing devices which dispense one material or several materials which are to be mixed together to form a foam compound. Hole 96 is formed in wall 83 of mixer 80 and is positioned between rear end 89 and helical mixing element 90. Both of the materials are injected with the pressurized air after the materials have been exposed to one another within rear end 89, but before the materials have been thoroughly mixed together by static mixing element 90. Mixer 80 is preferably formed of an inexpensive plastic material, allowing the mixer to be discarded after use. Air hose 110 is easily removed from fitting 100 allowing dispensing device 1 to be used with additional cartridges and additional mixers.

Accordingly, the improved foam dispensing device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved foam dispensing device is constructed and used, the characteristics of the construction, and the advantageous, new and useful results obtained, the new and useful structures, devices, elements, arrangements, parts and combinations, are set forth in the appended claims.

I claim:

1. A dispensing device for dispensing a foam material, said device including:

a housing;

a cartridge stored in the housing and adapted to contain at least one material, said cartridge having a dispensing end;

a pressure mechanism for forcing the material out the dispensing end of the cartridge;

a dispensing tube mounted to the dispensing end of the cartridge, said dispensing tube having a wall formed with a passageway and a first open end which attaches to the dispensing end of the cartridge and a second open end opposite the first open end;

a static mixing element positioned within the passageway of the dispensing tube between the first and second open ends of the dispensing tube; and means communicating with the dispensing tube for supplying a pressurized gas into the passageway for mixing with the material for forming the foam material, said means including an air compressor which generates the pressurized gas and a first air hose extending between the air compressor and an air hose fitting attached to the dispensing tube and communicating with a hole formed in the wall of the dispensing tube between the static mixing element and the first open end of said dispensing tube, said air compressor supplying pressurized gas to the pressure mechanism for forcing the material out the dispensing end of the cartridge.

2. The dispensing device defined in claim 1 further including a pressure regulator connected to the pressure mechanism for regulating the amount of pressurized gas supplied to said pressure mechanism, and a second air hose connected between the air compressor and the pressure regulator.

3. The dispensing device defined in claim 2 further including a coupling connected between the second air hose and the pressure regulator for diverting a portion of the pressurized gas through the first air hose.

4. The dispensing device defined in claim 3 in which the static mixing element is helical shaped.

5. The dispensing device defined in claim 4 in which the dispensing end of the cartridge includes a valve for controlling the flow of the material out of the cartridge.

6. In combination, a dispensing device for dispensing at least two materials as a foam compound in a motionless mixing tube which connects to a dispensing end of the dispensing device for aerating and mixing the two materials to form said foam compound, said dispensing device including:

a dispensing gun;

at least two supplies of flowable material communicating with the dispensing gun;

pressure means for forcing the two materials out of the dispensing gun;

a dispensing tube mounted on a dispensing end of the dispensing gun, said dispensing tube having a wall formed with a passageway and a first open end which attaches to the dispensing end of the gun and a second open end opposite the first open end;

a static mixing element having first and second ends contained within the passageway of the tube and extending between the first and second open ends of said tube, said first end being located adjacent the dispensing end of the gun;

a supply of pressurized gas;

a hole formed in the wall of the tube between the first open end of the tube and before the second end of the static mixing element; and a first hose extending between the supply of pressurized gas and a fitting attached to the dispensing tube and communicating with a hole formed in the wall of the dispensing tube for supplying pressurized gas through the hole and into the passageway of the tube for mixing with the material.

7. The combination defined in claim 6 in which the pressure means for forcing the two materials out of the dispensing gun includes an air compressor.

8. The combination defined in claim 7 in which the air compressor communicates with the first hose and the dispensing tube for supplying pressurized gas into the passageway of the tube.

9. The combination defined in claim 8 which further includes a pressure regulator connected to the air compressor for regulating the amount of pressurized gas supplied to said pressure means and to the dispensing tube.

10. The combination defined in claim 9 which further includes a coupling connected between the pressure regulator and the air compressor for diverting a portion of the pressurized gas through the first air hose.

11. The combination defined in claim 6 in which the static mixing element is helical shaped.

12. The combination defined in claim 6 in which the dispensing end of the dispensing gun includes a valve for controlling the flow of the material out of said gun.

* * * * *